US005823131A

United States Patent [19]

Boatman et al.

[11] Patent Number: 5,823,131

[45] Date of Patent: Oct. 20, 1998

[54] METHOD AND APPARATUS FOR DISCONNECTING AND RETRIEVING MULTIPLE RISERS ATTACHED TO A FLOATING VESSEL

[75] Inventors: L. Terry Boatman; Ron L. Kelm, both of Houston; Brent A. Salyer, Cypress; Jerry L. McCollum, Hempstead; Charles O. Etheridge, Spring, all of Tex.

[73] Assignee: FMC Corporation, Chicago, Ill.

[21] Appl. No.: 970,949

[22] Filed: Nov. 14, 199

Related U.S. Application Data

[60] Provisional application No. 60/033,668 Dec. 18, 1996. 7

[51] Int. Cl.[6] ..... B63B 22/02

[52] U.S. Cl. ..... 114/230; 441/4

[58] Field of Search ..... 166/352–355; 441/3–5; 114/230, 293

[56] References Cited

U.S. PATENT DOCUMENTS

| | | | |
|---|---|---|---|
| 2,666,934 | 1/1954 | Leifheit . | |
| 3,605,668 | 9/1971 | Morgan . | |
| 4,478,586 | 10/1984 | Gentry et al. | 441/4 |
| 4,648,848 | 3/1987 | Busch . | |
| 4,892,495 | 1/1990 | Svensen . | |
| 5,456,622 | 10/1995 | Breivik et al. . | |
| 5,540,607 | 7/1996 | Breivik et al. | 441/5 |

*Primary Examiner*—Ed L. Swinehart
*Attorney, Agent, or Firm*—Bush, Riddle, & Jackson, L.L.P.

[57] ABSTRACT

A riser buoy (36) supports a plurality of risers (19) and is releasably docked within a generally cylindrical turret (20) of a floating storage vessel (10) at a location above the sea level (12) to provide dry access to quick disconnect/connect mating couplings (32, 40) on the turret (20) and riser buoy (36). A weight (58) connected by anchor chain (44) to riser buoy (36) is connected at its upper end to a retrieval line (60) which is controlled by a winch (62). Riser buoy (36) upon disconnection from vessel (10) is positioned at a predetermined submerged water depth below tanker traffic and high wave loads. Riser buoy (36) is docked within turret (20) independently of positioning means such as anchor chains (17) between the sea bed and the turret, or a thrusting positioning system including thrusters (16) of the vessel.

14 Claims, 5 Drawing Sheets

METHOD AND APPARATUS FOR DISCONNECTING AND RETRIEVING MULTIPLE RISERS ATTACHED TO A FLOATING VESSEL

REFERENCE TO RELATED PROVISIONAL APPLICATION

This application claims the benefit of provisional application Ser. No. 60/033668 filed Dec. 8, 1996.

BACKGROUND OF THE INVENTION

1. Field of the Invention

This invention relates to a method and apparatus for disconnecting and retrieving multiple risers attached to a floating vessel, and more particularly to such an apparatus and method in which the vessel includes a turret having a releasable riser buoy with a plurality of flexible risers supported thereon for docking within the turret.

2. Description of the Prior Art

Heretofore, it has been known to provide a vessel having a turret about which the vessel may weathervane with the turret anchored to the sea floor and with risers extending between sea floor wells and the turret for the transport of production fluids to the vessel. Also, it has been known to provide a deep water mooring system in which a submerged anchor member has been provided to support risers when disconnected from the vessel.

The de Baan et al. U.S. Pat. No. 5,044,297 dated Sep. 3, 1991 shows a deep water mooring system in which submerged flotation tanks support production risers or lines in addition to mooring lines. A floating marker buoy includes a retrieval line connected to the submerged flotation tanks so that the risers and the mooring lines may be easily retrieved for connection to a vessel after being disconnected from a previous vessel. A mooring weight on the sea floor may be connected to the flotation tanks to anchor the flotation tanks at a predetermined water depth. The vessel normally includes storage tanks for the production fluids transported by the risers. The support buoys of the '297 patent are not received within a turret; they are provided primarily for the support of mooring lines. The buoys or flotation tanks always remain in a submerged location away from the vessel.

U.S. Pat. No. 4,509,448 dated Apr. 9, 1985 shows buoys for supporting mooring lines of a drillship both in a submerged position when connected to a vessel and in a floating position on the sea surface when the mooring lines are disconnected from the vessel. The buoys may be pulled onto the deck of a workboat. The buoys do not support risers or riser lines.

U.S. Pat. No. 5,306,186 which issued Apr. 26, 1994 shows a disconnectable mooring system including a buoy disconnectable from a turret and in equilibrium depth beneath the surface of the sea, such as 100 feet. They buoy supports mooring lines in addition to risers. The buoy is docked against the lower end of the turret and is not received within the turret. The entire disclosure of U.S. Pat. No. 5,306,186 is incorporated by this reference.

It is an object of this invention to provide a disconnectable riser buoy for supporting only risers or riser lines, but not mooring lines.

It is a further object of this invention to provide a disconnectable riser buoy for docking within a turret on a floating vessel.

Another object of the invention is to provide a riser buoy which carries risers which are connected to flow paths which are removably coupled to vessel product lines at a position above sea level.

Another object of the invention is to provide a riser buoy when disconnected from a turret is maintained at a submerged depth in the sea by a buoy anchor leg which is attached to a weight which may be lowered down to the sea floor or raised to the bottom of the turret.

SUMMARY OF THE INVENTION

The present invention is for a method and apparatus for connecting, disconnecting, and retrieving multiple risers or umbilicals for a floating vessel. The risers extend to sea floor manifolds or wells. Production fluids are transported by the risers to storage areas of the floating vessel. A riser buoy is removably connected to the turret which is rotatably coupled with the vessel. The turret is anchored to the sea floor independently of the riser buoy. Multiple risers are carried by the riser buoy. The risers are grouped in predetermined assemblies which are connected to the riser buoy. For example, three groups of riser lines may be carried or connected to the riser buoy. The riser buoy is connected to the turret at a location above the draft line or sea level surface in order to provide access to the riser connections during and after mating of the riser buoy to the turret.

A retractable weight or gravity base is mounted on the riser buoy. Upon release of the riser buoy from the turret, the weight is payed out until it comes to rest on the sea bed in order to moor the riser buoy and limit the excursions of the risers within acceptable limits. By pre-determining the length of the line from the retractable weight to the riser buoy, the riser buoy may be positioned at a precise water depth when released from the turret to permit the riser buoy and risers to be located below the tanker or other vessel traffic and to be beneath a region of high wave loads.

The riser buoy of the present invention does not have buoyancy sufficient to support the mooring lines; thus, it may be substantially smaller than buoys designed to support mooring lines simultaneously with risers. The turret receives the buoy in a docked position at a height above the sea level within the turret. Quick disconnect/connect couplings are provided between the buoy flow paths in the buoy for the flexible risers and product conduits on the turret. Thus, workmen are provided dry access for coupling and uncoupling the quick disconnect/connect couplings in the docked position of the riser buoy.

The lower end portion of the turret is curved. The flexible riser lines may contact the lower curved portion of the turret when the riser buoy is in the docked position in the turret. If such contact occurs, lateral loads are transferred from the risers to the turret.

BRIEF DESCRIPTION OF THE DRAWINGS

The objects, advantages and features of the invention will become more apparent by reference to the drawings which are appended hereto and wherein an illustrative embodiment of the invention is shown, of which:

FIG. 7 is a schematic view showing the riser buoy with a retrieval line connected at its upper end to a floating marker buoy, with a dotted line view of the riser buoy, cable, retrieval line and risers illustrated when the buoy is forced to a non-vertical position by sea currents or the like.

DESCRIPTION OF THE INVENTION

Figure 1:
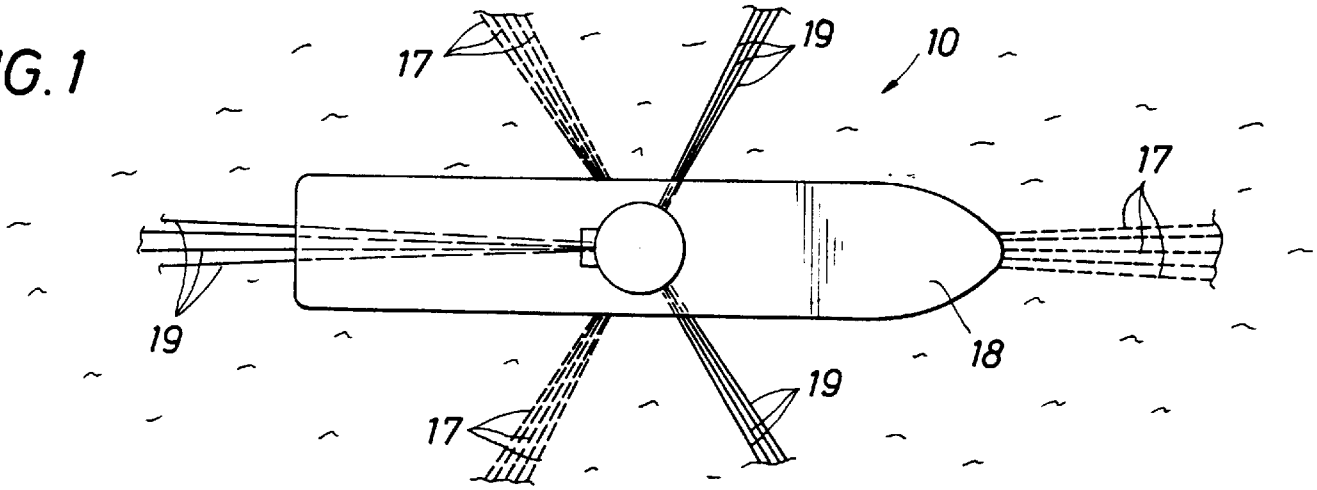
FIG. 1 is a schematic view showing a vessel having a turret about which the vessel weathervanes with riser groups releasably connected to the turret.
Figure 2:
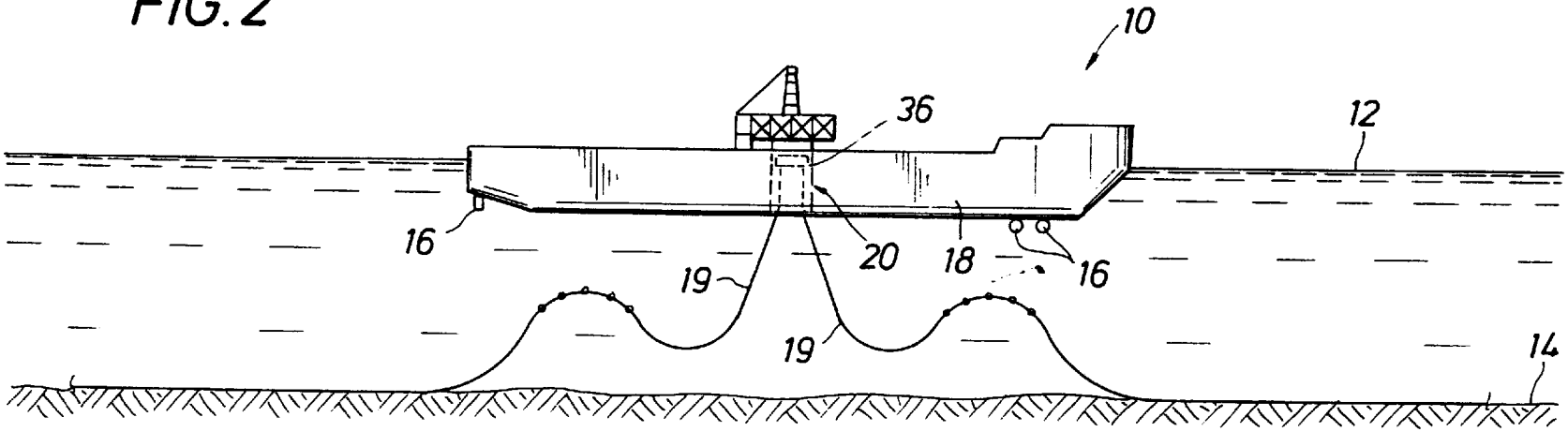
FIG. 2 is a side elevational view, partly schematic, of the vessel shown in FIG. 1 showing the plurality of risers connected to a riser buoy docked to a turret with the risers extending down to product flow lines on the sea bed for the transport of production fluids from manifolds or seabed wells.
Figure 3:
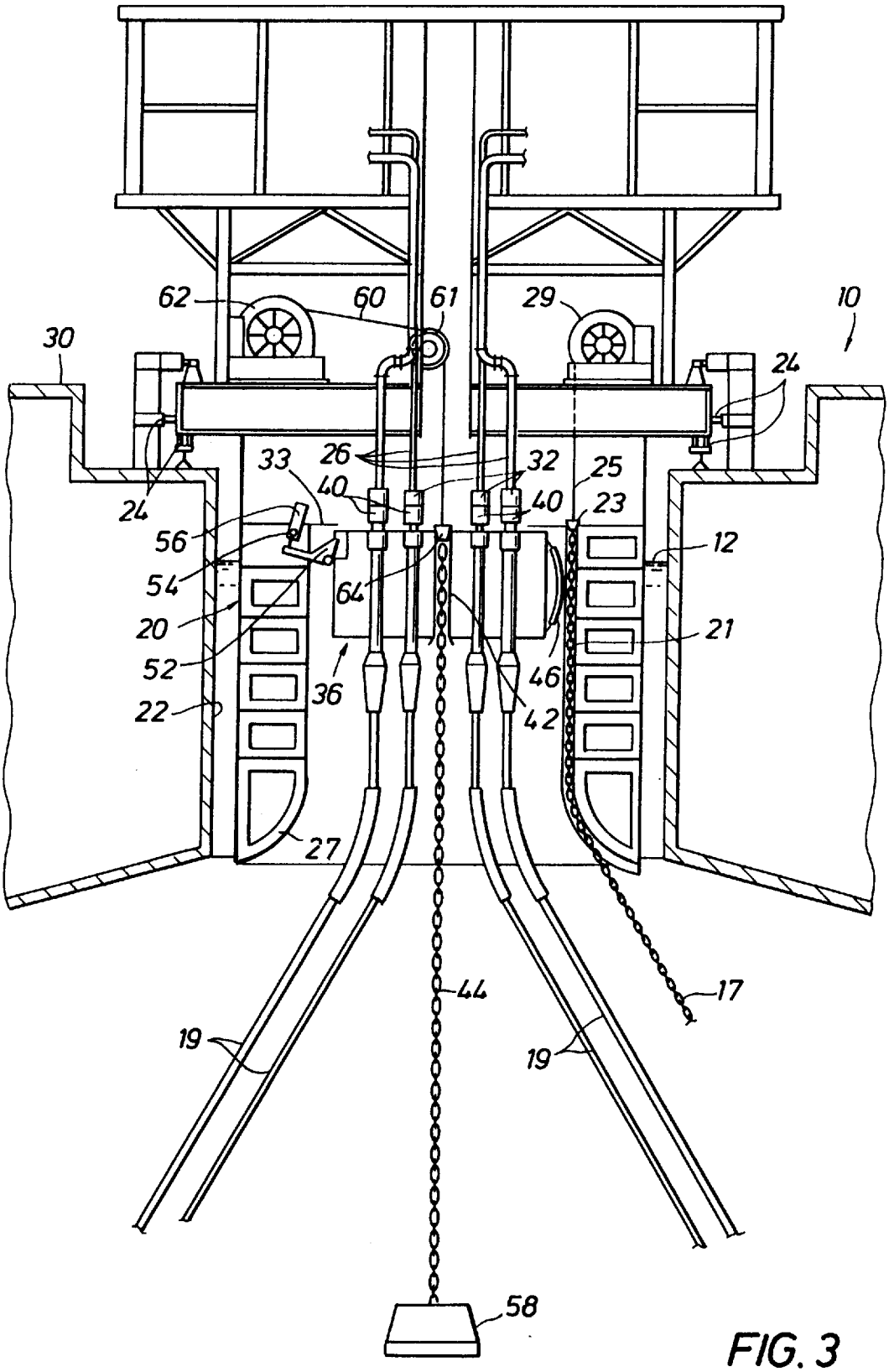
FIG. 3 is an enlarged sectional view of a turret mounted on a vessel and showing a riser buoy with risers connected thereto and docked within the turret and with anchor chains connected independently of the riser buoy body to the upper portion of the turret.

Referring particularly to FIGS. 1, 2 and 3, a storage vessel 10, is shown for the storage and/or collection and transport of production fluids, such as oil or gas from sea floor manifolds or wells (not illustrated) . The surface of the sea is shown at 12; the sea bed is shown at 14. A generally cylindrical turret 20 is mounted within a vertical opening or moon pool 22 of vessel 10 and is supported on bearing assemblies 24 so that when anchored to the sea floor 14, the vessel 10 may rotate about the turret 20. Alternatively, or in addition, thrusters 16 may be mounted externally on the bottom of the hull 18 of vessel 10 for positioning and maintaining vessel 10 at a desired position in the sea.

Three groups of mooring lines 17 as shown in FIG. 1 anchor the turret 20 to the sea bed 14 for mooring of vessel 10. Mooring lines 17 may not be necessary if vessel 10 is positioned solely by thrusters 16. Three groups of risers 19 which are coupled to subsea wells or manifolds (not illustrated) are positioned between the three groups of mooring lines 17 to minimize any interference between mooring lines 17 and risers 19.

Turret 20 has product conduits or lines 26 placed thereon for coupling to risers 19. Suitable swivel arrangements as well known (not shown) may be provided for fluid rotative coupling between conduits 26 and suitable conduits fixed to vessel 10 which extend to storage areas or tanks within vessel 10.

The lower end portion of turret 20 has a bend shoe or fender shown at 27 with a beveled or arcuate contour for fairleading riser lines 19 in order to cause a substantial portion of the lateral loads from the riser lines 19 to be reacted directly by turret 20. In one preferred embodiment, mooring lines or chains 17 extend through tubular guides 21 on turret 20 and are removable connected by stoppers 23 at the upper ends of guide 21. Stoppers 23 as well known fit about a link of chain 17. A retrieval line 25 is connected to a winch 29 for pulling in chain 17. Mooring lines 17 may be disconnected from turret 20 by removal of stoppers 23. If it is desired to move vessel 10 to another location, a separate retrieval line (not shown) for each mooring line 17 may be connected to a marker buoy.

An upper main deck 30 is provided on vessel 10. The operating water level or sea level 12 is below deck 30 and below the position of quick disconnect/connect couplings 32 for product conduits 26 thereby permitting product conduits 26 to be connected to buoy flow paths for risers 19 above the sea as explained below. A walkway 33 for workman is provided for workmen access above sea level 12 adjacent docked buoy 36.

Figure 4:
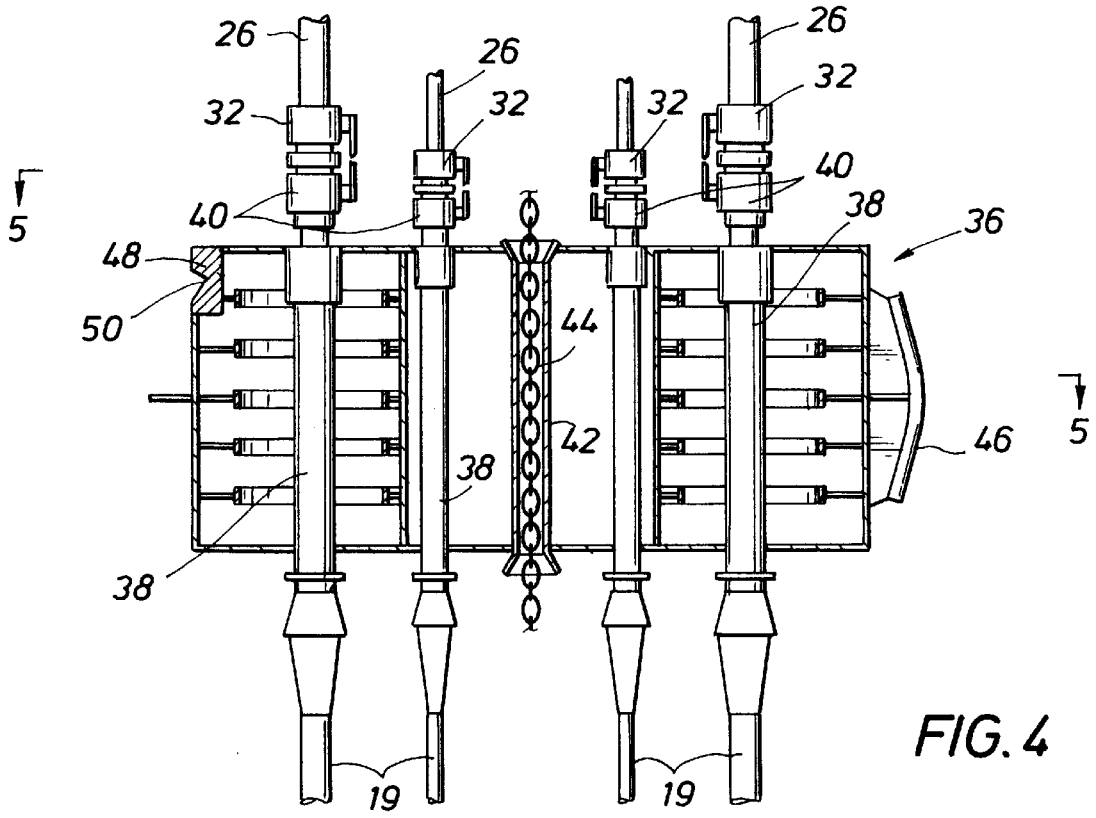
FIG. 4 is an elevational view of the riser buoy comprising the present invention removed from the turret.
Figure 5:
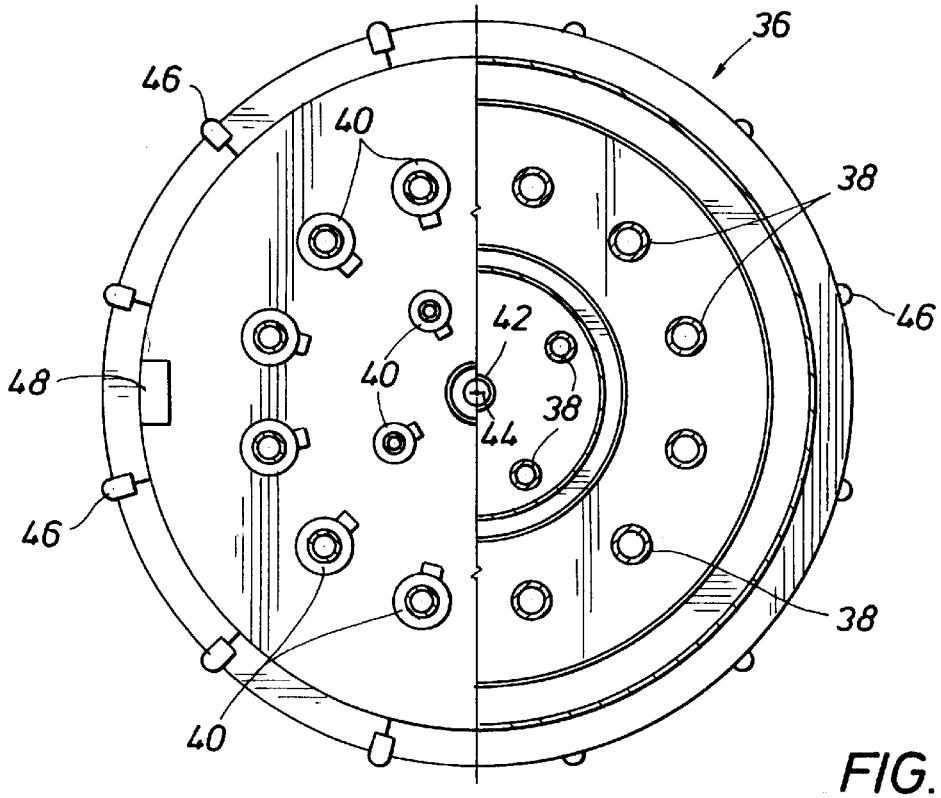
FIG. 5 is a top plan of the riser buoy when viewed from section lines 5—5 shown in FIG. 4.
Figure 6:
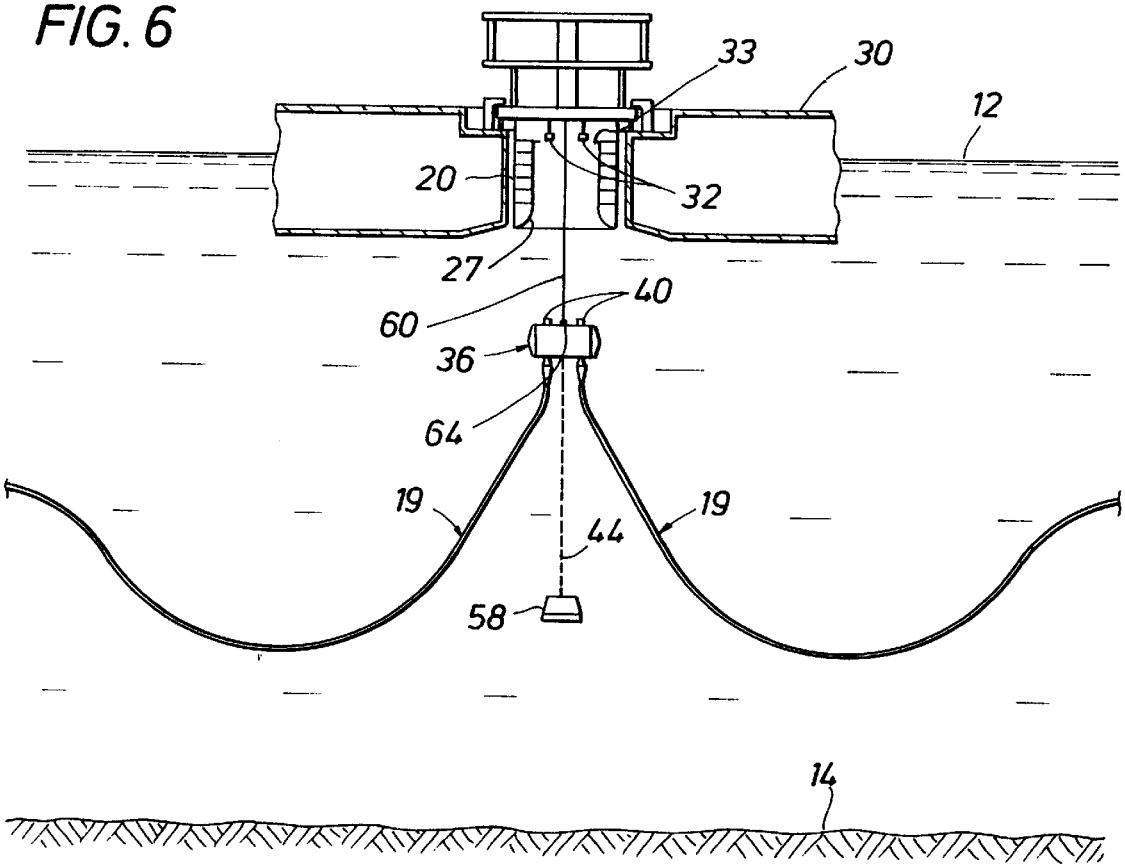
FIG. 6 is an elevational view, partly schematic, showing the riser buoy and supported risers of the invention released from the turret and being lowered toward the sea floor with a weight suspended from the riser buoy for positioning the riser buoy at a predetermined water depth and location relative to the sea floor, the weight shown connected to the riser buoy by means of a cable or line shown in broken lines.

Referring further to FIGS. 4 and 5, a riser buoy 36 includes a plurality of product passages or "flow paths" 38 therein connected to lower flexible risers 19. Upper quick disconnect/connect couplings 40 are provided for releasable connection to mating couplings 32 when in the docked position of riser buoy 36 shown in FIG. 3. Suitable quick disconnect/connect couplings 32, 40 are available from several manufacturers. A center hawse pipe 42 in riser buoy 36 receives a buoy anchor chain 44 therein.

Spaced bumper members 46 are arcuately spaced about the outer periphery of riser buoy 36. Bumper members 46 are preferably of an elastomeric material for contacting the inner periphery of turret 20 when docking. For docking riser buoy 36 at a predetermined location, three recesses or slots 48 having notches 50 therein are provided about the outer periphery of buoy 36. Locking arms 52 are pivotally mounted at 54 to turret 20 and are actuated by hydraulic cylinders 56. Cylinders 56 are actuated to move locking arms 52 into engagement with notches 50.

Buoy anchor chain 44 has a weight or gravity base 58 connected to its lower end. A light weight retrieval line 60 is connected to the upper end of anchor chain 44. Upper retrieval line 60 is connected to a winch 62 for paying weight 58 in and out relative to riser buoy 36. A removable stopper 64 is positioned on the upper end of chain 44 for engaging the upper end of hawse pipe 42 when weight 58 is at a desired distance from riser buoy 36 for deployment. If vessel 10 is disconnected from mooring lines 17 and moved to another location, retrieval line 60 may be disconnected from turret 20 and connected to a marker buoy 66 as in FIG. 7 for floating on the sea surface. If desired, a retrieval line may be connected to anchor chain 44 for connection to marker buoy 66.

For docking riser buoy 36, retrieval line 60 is pulled upwardly over pulley 61 by winch 62 along with weight 58 and anchor chain 44 until weight 58 contacts buoy 36. Then, buoy 36 and weight 58 move upwardly together. Quick disconnect/connect couplings 32 and 40 are vertically aligned, and riser buoy 36 is drawn upwardly inside turret 20 until its top surface is above sea level 12. Thus dry access is provided for connecting couplings 32 and 40. When in proper position, locking arms 52 are actuated into notches 50 to secure riser buoy 36 to turret 20. Then, couplings 32 and 40 are connected.

Turret 20 has a lower circumferential fender or shoe 27 as best seen in FIG. 3. When risers 19 are angled outwardly into contact with shoe 27, a portion of the lateral load from risers 19 is opposed directly by turret 20 and shoe 27 thereby reducing the load on riser buoy 36 and its connections to turret 20. In the position of FIG. 3, product may flow from subsea wells through risers 19 and conduits 26 to suitable storage compartments in vessel 10.

Figure 7:
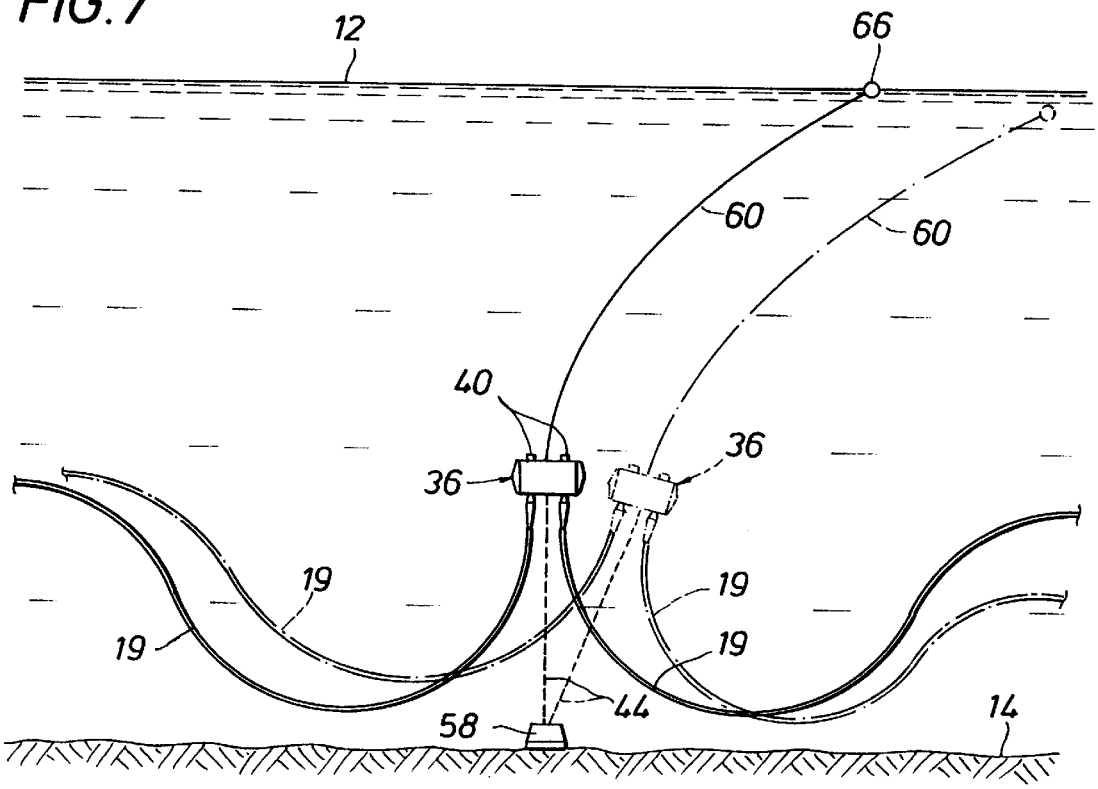

After loading of vessel 10 with product for transport to another location (or for a FPSO which must be moved because of an approaching storm or ice flow), quick disconnects 32, 40 of product conduits 26 are disconnected from risers 19. Next, buoy anchor chain 44 and retrieval line 60 along with weight 58 are lowered by winch 62 until a stopper 64 on chain 44 contacts the upper flared end of pipe 42. Weight 58, along with buoy 36, then moves downwardly by gravity in the sea until weight 58 contacts sea bed 14. The length of chain 44 is predetermined in order to position riser buoy 34 at a predetermined submerged location as shown in FIG. 7. Retrieval line 60 is connected between buoy 36 and marker buoy 66. If desired, a second retrieval line may be connected to a second marker buoy 66 to provide redundancy in the event of failure of a marker buoy or retrieval line. Retrieval line 60 is normally releasably connected to marker buoy 66 by a workman in a small boat.

When the same or another vessel returns to the vicinity of buoy 36, it may be positioned near marker buoy 66 for retrieving line 60. Retrieval line 60 is disconnected from marker buoy 66 and passed over suitable pulleys 61 to winch 62 for lifting riser buoy 36 along with the associated supported risers 19 to within turret 20.

The broken line view of buoy 36 in FIG. 7 shows the excursions of riser buoy 36 and marker buoy 66 resulting from wind, waves, and water currents or the like or when it is being retrieved by means of winch 62. Riser buoy 36 may be positioned at a water depth of about fifty (50) meters below the surface 12 which permits riser buoy 36 to be suspended below tanker traffic and beneath the region of high wave loads. Furthermore, direct contact between risers 19 and sea bed 14 may be minimized by the length of buoy anchor chain 44 depending on the position of the manifolds or subsea wells on sea bed 14.

Weight or gravity base 58 is pulled to the underside of riser buoy 36 by retrieval line 60 during docking. Thus, weight or gravity base 58 is protected by turret 20 when riser buoy 36 is in docked position within turret 20 thereby shielding weight 58 from hydrodynamic loading and vessel motions.

The riser buoy arrangment of the present invention for a floating storage vessel provides an arrangement of apparatus for disconnecting a plurality of risers 19 from turret 20 while keeping the risers 19 grouped together in disconnected condition. In addition, the riser buoy 36 allows the risers 19 to be suspended in the sea above the sea bed yet below tanker traffic and beneath the region of high wave loads. Because risers 19 are supported in the sea while in a disconnected condition, contact between risers 19 and the sea bed 14 is reduced or prevented.

Riser buoy 40 may be used with storage vessels that do not require anchor legs secured to the sea bottom for maintaining the position of the vessel. Such vessels may be maneuvered by thrusters only without mooring anchor legs.

Figure 8:
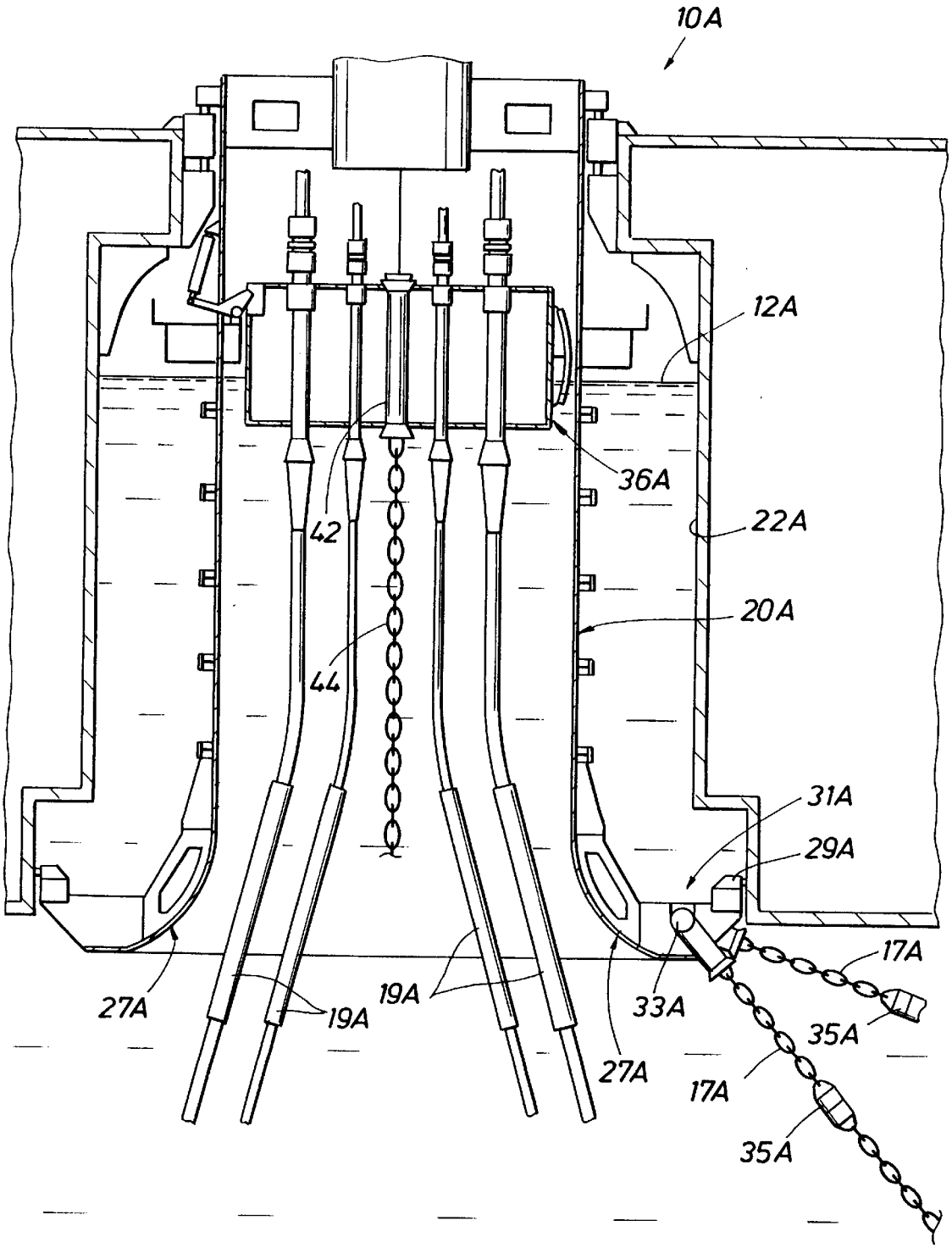
FIG. 8 is a partial sectional view of an alternative embodiment of anchor legs secured to the lower end portion of the turret.

Referring to FIG. 8, an alternative mooring arrangement for the vessel and turret is illustrated. Turret 20A is mounted in vertical opening 22A of vessel 10A. A lower bearing assembly 29A engages the hull of vessel 10A. A chain support assembly generally indicated at 31A secures the upper ends of mooring or anchor legs 17A about a pivot 33A. A release link 35A is provided for each anchor leg or chain 17A. Risers 19A are secured to riser buoy 36A as in the embodiment of FIGS. 1–7. The sea water level 12A in moon pool 20A is below the top surface of riser buoy 36A when in the docked position.

While preferred embodiments of the present invention have been illustrated in detail, it is apparent that modifications and adaptions of the preferred embodiments will occur to those skilled in the art. However, it is to be expressly understood that such modifications and adaptations are within the spirit and scope of the present invention as set forth in the following claims.

What is claimed is:

1. A method for connecting and disconnecting multiple flexible risers extending to the sea bed to a floating vessel having a turret mounted within a vertical opening of the vessel comprising the steps of:

supporting upper ends of said multiple flexible risers with a riser buoy;

removably connecting said riser buoy to the turret at a predetermined position within the turret above sea level;

positioning said vessel in the sea with respect to positions of said multiple flexible risers independently of said riser buoy;

removably connecting said multiple flexible risers on said riser buoy to product conduits on said vessel for the transport of product to a desired storage area;

disconnecting said riser buoy and said multiple flexible risers supported thereon from said vessel for movement of said riser buoy and risers to a predetermined submerged depth within the sea, connecting a weight to said riser buoy with a predetermined length of buoy anchor line;

lowering said weight to the sea bottom such that a predetermined submerged depth of said riser buoy is determined by the length of said buoy anchor line, and raising said buoy anchor line and weight into a mating position of said weight to said riser buoy when said riser buoy is connected to and docked within said turret.

2. The method of claim 1 wherein:

said steps of connecting and disconnecting multiple flexible risers on said riser buoy to product conduits are performed above sea level.

3. The method of claim 1 after the riser buoy is disconnected from said riser buoy further including the steps of:

connecting a lower end of a retrieval line to said riser buoy; and connecting an upper end of said retrieval line to a marker buoy floating on the sea surface.

4. The method of claim 1 including the step of:

docking said riser buoy within said turret with a top portion of said riser buoy at a position above sea level so that dry access is provided for connecting flow paths of said multiple flexible risers to said product conduits on said vessel.

5. The method of claim 1 including the steps of:

providing a generally cylindrical turret having an arcuate lower end portion adjacent the bottom of said vessel such that if one of said risers contacts said arcuate end portion, lateral load of said one riser is transferred to said turret.

6. In combination with a floating vessel having a generally cylindrical turret mounted within a vertical opening in said vessel with the sea level positioned intermediate the length of said turret, the turret having a plurality of product conduits thereon;

a riser buoy releasably docked within said turret;

a plurality of flexible risers having upper ends mounted on said riser buoy and extending downwardly to the sea bottom for the transport of product from subsea wells;

a plurality of couplings for releasably establishing flow paths between said flexible risers and said product conduits on said turret;

a buoy weight coupled to said riser buoy by a buoy anchor line, means for raising said buoy anchor line until said weight is within said turret beneath said buoy and for lowering said buoy anchor line downward until said weight is below said buoy at a predetermined length, such that after release of said riser buoy from said turret, said weight is supported on the sea bottom with said riser buoy extending upwardly in the sea at a predetermined distance corresponding to said predetermined length.

7. The combination of claim 6 wherein said means for raising and lowering said buoy anchor lines includes a winch mounted on said turret and a retrieval line connected at a first end to said anchor line and releasably connected at a second end to said winch, said retrieval line and said winch being arranged and designed such that when said retrieval line is released from said winch, and said riser buoy is undocked from said turret, said weight lowers said riser buoy to a submerged position below said vessel.

8. The combination of claim 7 further comprising:

a marker buoy connected to said first end of said retrieval line when said riser buoy is undocked from said turret.

9. A riser support structure for supporting flexible risers within a generally cylindrical turret mounted in a vertical opening of a vessel, the turret having a plurality of product conduits disposed therein for releasable connection to said flexible risers; said riser support structure comprising:

mooring lines connected directly to said turret for anchoring said turret to the sea bed;

a riser buoy arranged and designed for docking within said turret independently of said mooring lines;

means for releasably docking said riser buoy within said turret;

a plurality of flexible risers having upper ends connected to product flow paths of said riser buoy; said risers extending downwardly to the sea bed for the transport of product; and a plurality of couplings for releasably connecting said product flow paths to said product conduits on said turret at a location within said cylindrical turret.

10. A riser support structure for supporting flexible risers within a generally cylindrical turret mounted in a vertical opening of a vessel, the turret having a plurality of product conduits disposed therein for releasable connection to said flexible risers; said riser support structure comprising:

positioning means for positioning said vessel in the sea;

a riser buoy arranged and designed for docking within said turret independently of said positioning means;

means for releasably docking said riser buoy within said turret;

a plurality of flexible risers having upper ends connected to product flow paths of said riser buoy; said risers extending downwardly to the sea bed for the transport of product;

a plurality of couplings for releasably connecting said product flow paths to said product conduits on said turret at a location within said cylindrical turret, wherein said means for releasbly docking includes, a retrieval line connected to said riser buoy; and winch means on said vessel for pulling said retrieval line and said riser buoy to a docked position within said turret, and further comprising:

a weight connected to a lower end of said retrieval line which is arranged and designed to be pulled tightly against said riser buoy in said docked position of the riser buoy.

11. A riser support structure of claim 10 wherein:

said retrieval line includes a lower anchor chain connected to said weight and mounted on said riser buoy for lowering down and raising up relative to said riser buoy, said chain having a stop engaging said riser buoy when said weight reaches a predetermined distance below said riser buoy after release of said retireval line and riser buoy from a docked position, thereby permitting said weight to be supported on said sea bed at a predetermined submerged position of said riser buoy.

12. A riser support structure of claim 11 wherein:

a marker buoy is provided on the sea surface adjacent said vessel; and said retrieval line is connected to said marker buoy after release of said riser buoy from said docked position.

13. A riser support structure of claim 10 wherein:

said positioning means include mooring lines connected directly to said turret for anchoring said turret to the sea bed.

14. A riser support structure of claim 10 wherein:

said positioning means includes thrusters on said vessel for maintaining a position in the sea with respect to said flexible risers.

* * * * *